United States Patent [19]

Lierke

[11] Patent Number: 4,900,527

[45] Date of Patent: Feb. 13, 1990

[54] APPLIANCE FOR STERILIZING CONTAINERS

[75] Inventor: Ernst G. Lierke, Schwalbach, Fed. Rep. of Germany

[73] Assignee: Kolbus GmbH & Co. KG, Rahden, Fed. Rep. of Germany

[21] Appl. No.: 137,660

[22] Filed: Dec. 24, 1987

[30] Foreign Application Priority Data

Dec. 24, 1986 [DE] Fed. Rep. of Germany ..... 3644486

[51] Int. Cl.[4] ..... A61L 2/18; A61L 2/26

[52] U.S. Cl. ..... 422/302; 55/123; 55/150; 55/152; 367/213; 367/228

[58] Field of Search ..... 422/302, 303; 55/123, 55/150, 152; 361/228, 213

[56] References Cited

U.S. PATENT DOCUMENTS

| | | | |
|---|---|---|---|
| 2,014,750 | 9/1935 | Stegemann | 422/113 |
| 2,826,513 | 3/1958 | Blanchard | 427/28 |
| 3,090,745 | 5/1963 | Berghaus | 422/186.04 |
| 3,341,280 | 9/1967 | Eolkin | 422/31 |
| 3,421,840 | 1/1969 | Pechmann | 422/304 |
| 3,483,374 | 12/1969 | Erben | 361/213 X |
| 3,516,608 | 6/1970 | Bowen et al. | 239/706 |
| 3,624,448 | 11/1971 | Saurenman | 361/235 X |
| 3,668,008 | 6/1972 | Severynse | 361/213 X |
| 3,723,060 | 3/1973 | Lisiecki | 422/105 |
| 3,747,296 | 7/1973 | Zausner | 53/167 |
| 3,807,634 | 4/1974 | Vogt | 239/150 |
| 3,976,916 | 8/1976 | Saurenman | 361/213 |
| 4,027,201 | 5/1977 | Bacon et al. | 361/213 |
| 4,099,914 | 7/1978 | Gustafsson et al. | 53/426 |
| 4,169,123 | 9/1979 | Moore et al. | 422/29 |
| 4,296,068 | 10/1981 | Hoshino | 422/62 |
| 4,319,302 | 3/1982 | Moulden | 361/213 |
| 4,344,104 | 10/1982 | Habets et al. | 361/213 X |
| 4,424,189 | 1/1984 | Hick | 422/27 |
| 4,424,549 | 1/1984 | Ensing | 361/213 X |
| 4,498,116 | 2/1985 | Saurenman | 361/213 |
| 4,516,521 | 5/1985 | Szelagowski et al. | 118/50 |
| 4,542,434 | 9/1985 | Gehlke et al. | 361/213 X |
| 4,544,570 | 10/1985 | Plunkett et al. | 427/27 |
| 4,545,525 | 10/1985 | Sachar et al. | 239/3 |
| 4,630,167 | 12/1986 | Huggins | 361/213 |
| 4,642,728 | 2/1987 | Unger | 361/213 |
| 4,680,163 | 7/1987 | Blidschun et al. | 422/302 X |
| 4,729,057 | 3/1988 | Halleck | 361/213 |
| 4,734,580 | 3/1988 | Rodrigo et al. | 361/213 X |
| 4,774,729 | 9/1988 | Blitshteyn et al. | 361/213 |

OTHER PUBLICATIONS

Keng-Wutu et al., A High-Capacity Condensation Aerosol Generation System, Environmental Science & Technology (U.S.A.), vol. 13, pp. 698-701, 1979.

*Primary Examiner*—Robert J. Hill, Jr.
*Assistant Examiner*—Amalia L. Santiago
*Attorney, Agent, or Firm*—Chilton, Alix & Van Kirk

[57] ABSTRACT

Apparatus for sterilizing containers, for example open-topped plastic pots for receiving foodstuffs, comprises an aerosol generator which atomizes a liquid sterilizing agent and subsequently entrains the droplets of sterilizing agent in a carrier gas stream for delivery to a corona discharge wherein a charge is imparted to the droplets. The apparatus also comprises means for establishing an electrostatic field about a container to be sterilized whereby the charged droplets will be directed to the surface of the container to form a uniform coating thereon. The efficiency of the apparatus is enhanced by switching the polarity of the electrostatic field, for example as a function of corona current and also by minimizing the possibility of liquid sterilizing agent collecting on surfaces of the apparatus and subsequently falling on a surface of a container being treated.

20 Claims, 3 Drawing Sheets

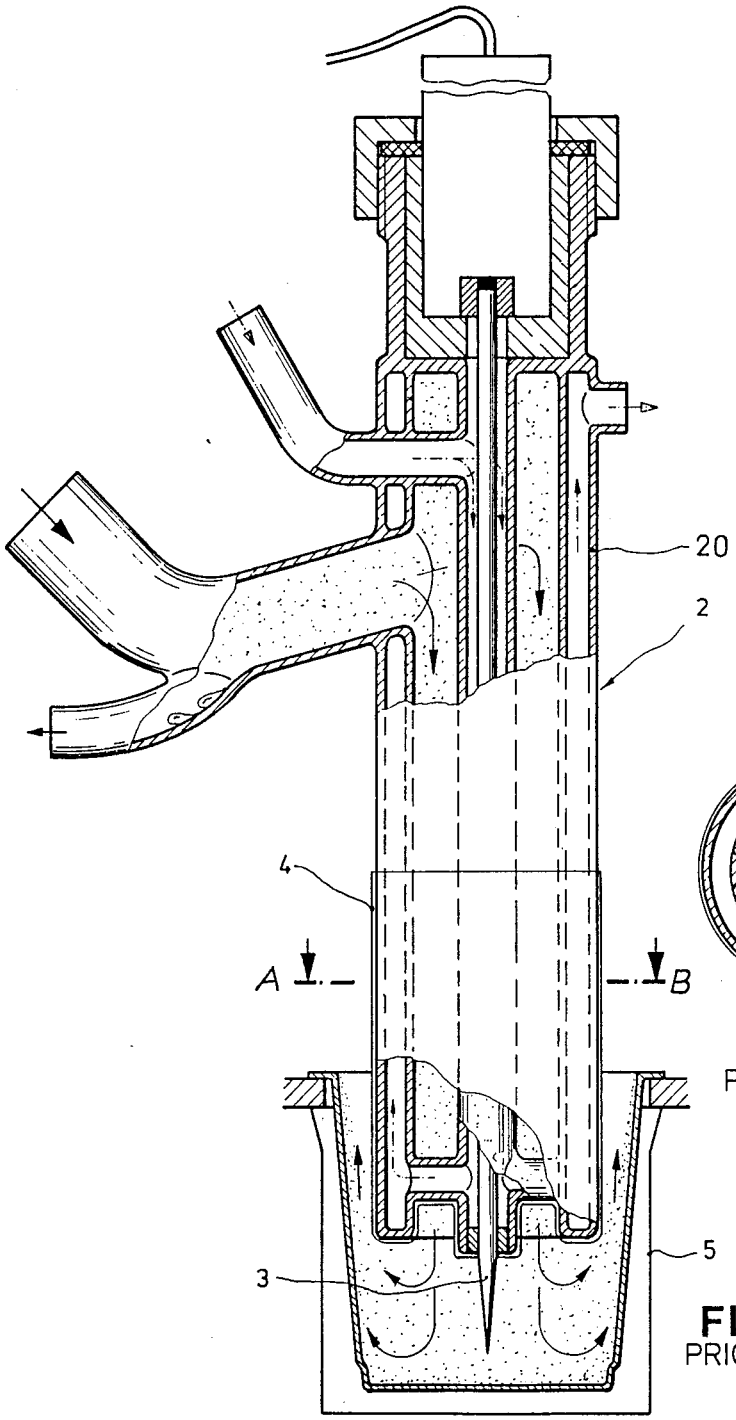
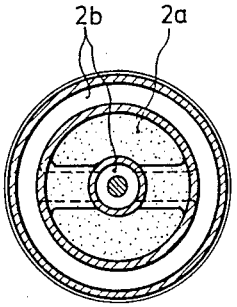
FIG. 2
PRIOR ART
FIG. 1
PRIOR ART

APPLIANCE FOR STERILIZING CONTAINERS

BACKGROUND OF THE INVENTION

1. Field of the Invention

The present invention relates to the sterilization of containers and particularly pot-like containers destined to receive foodstuffs. More specifically, this invention is directed to apparatus for applying a coating of a sterilizing agent to the interior surfaces of containers, such as plastic pots, in which dairy products are to be packaged for subsequent retail sale. Accordingly, the general objects of the present invention are to provide novel and improved methods and apparatus of such character.

2. Description of the Prior Art

Methods and apparatus for sterilizing containers, wherein a uniform coating of an atomized liquid sterilizing agent is deposited on the internal surfaces of the container, are known in the electrostatic art. Examples of prior art sterilizing appliances for use in treating open-topped plastic containers may be seen from U.S. Pat. No. 4,680,163 which is assigned to the assignee of the present invention and which is incorporated herein by reference. The prior art apparatus comprises an aerosol generator with an ultrasonic transducer that operates at frequencies in the MHz range. The aerosol generator produces droplets of a liquid sterilizing agent which are entrained in a controlled stream of carrier gas. The prior art apparatus further comprises a deposition arrangement in which the entrained droplets of sterilizing agent are charged by directing them into a corona discharge. The charged droplets are subsequently deposited onto the surfaces of the container under the influence of an electrostatic field. The apparatus by which the charging and subsequent uniform deposition of the droplets of sterilizing agent is achieved comprises a deposition head which extends into the container to be sterilized. This deposition head has a centrally located, pointed electrode that is energized by a high voltage generator. The deposition head further comprises an outer electrode which surrounds the container and an auxiliary electrode which also extends into the container and is coaxial with the pointed electrode and outer electrode although not coextensive in length therewith. The electrostatic field which causes the charged droplets to travel to and be deposited upon the container wall is established between the outer electrode, which is typically at ground potential, and the pointed electrode and auxiliary electrode.

While the above-described prior art sterilizing apparatus and the method encompassed by its operation have worked well, a number of areas in which functional improvement would be desirable have been observed. Thus, it has been discovered that the deposition of charged droplets of sterilizing agent on the wall of a non-conductive container being treated may result in a charge build up which effects the corona discharge being utilized to charge the droplets and, in fact, may cause the corona discharge to be extinguished. Condensation of the atomized sterilizing agent on surfaces of the apparatus has also sometimes presented an operational problem.

SUMMARY OF THE INVENTION

The present invention overcomes the above briefly discussed and other deficiencies of the prior art by providing novel and improved methods and apparatus particularly well suited for use in the sterilization of containers. Thus, an object of the present invention is to provide improved deposition heads for use in apparatii such as those shown in the above-referenced patent U.S. Pat. No. 4,680,163.

A further object of the invention is to enhance the safety of operation of sterilizing apparatus which utilizes an electrostatic field to cause the controlled deposition of charged droplets of a liquid sterilizing agent.

Yet another object of the invention is to increase the ease with which the the deposition heads of electrostatic sterilizing apparatus may be maintained and repaired.

In accordance with a first feature of the present invention, the polarity of the point electrode, about which the corona discharge is established, may be alternated between negative and positive polarity The polarity switching may be performed in response to a decrease in the corona current of a preselected magnitude.

In accordance with another feature of the present invention, a liquid is employed to heat the deposition head of the apparatus to thereby reduce the possibility of condensation of sterilizing agent on surfaces thereof.

Also in accordance with the invention, the surface area or areas within the deposition head where condensation is most likely to occur are directly heated and thus are maintained at a higher temperature when compared to other heated areas of the apparatus.

Also in accordance with the present invention, a chamber may be provided upstream of the inlet for the atomized sterilizing agent to the deposition head, the direction of flow of the sterilizing agent being changed within that chamber, and means may be provided to collect and drain condensate from the chamber thus preventing its flow into the deposition head.

A further novel feature of the present invention is the ability to employ, as the point electrode for the formation of the corona discharge, either a replaceable wire which extends through a tube of insulating material or a replaceable pointed tip which connects to an insulated conductor extending along the axis of the deposition head.

In the interest of enhancing durability, since a deposition head in accordance with the present invention will typically be primarily fabricated from glass, the deposition head may be coated on either its exterior surface or both the exterior and interior surfaces with a plastic which prevents shattering and which is both heat-resistant and chemically stable.

BRIEF DESCRIPTION OF THE DRAWINGS

The present invention may be better understood and its numerous advantages will become apparent to those skilled in the art by reference to the accompanying drawing wherein like reference numbers refer to like elements in the several figures and in which:

FIG. 1 depicts, partly in cross-section, a deposition head in accordance with the prior art;

FIG. 2 is a cross-sectional view, taken along line A-B, of the apparatus of FIG. 1;

DESCRIPTION OF THE DISCLOSED EMBODIMENTS

Figure 3:
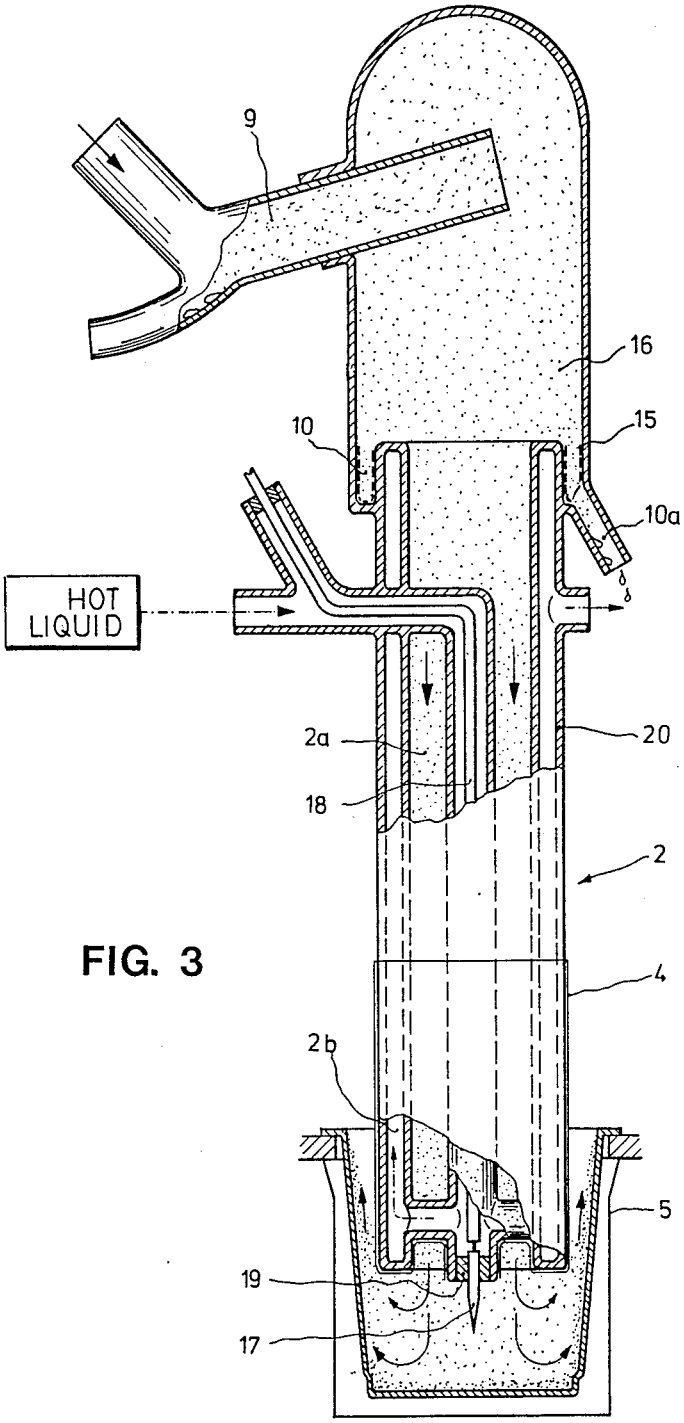
FIG. 3 is a view similar to FIG. 1 showing an improved deposition head employing several of the novel features of the present invention.
Figure 4:
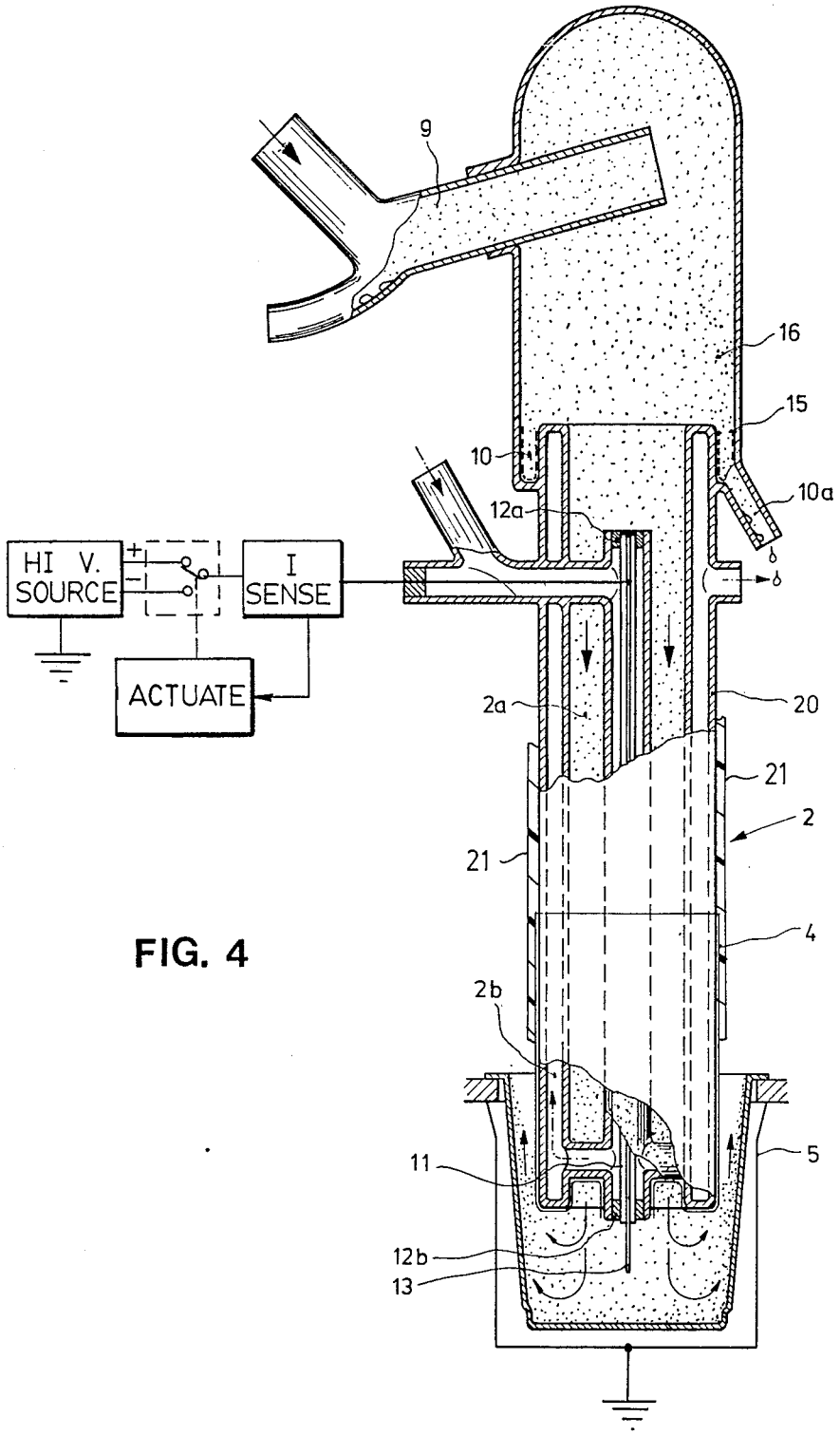
FIG. 4 is a view similar to FIG. 1 of an improved deposition head depicting additional novel features in accordance with the invention.

Referring initially to FIGS. 1 and 2, which as noted above depicts the prior art, the deposition head 2 comprises a glass body 20. A pointed electrode 3 is supported coaxially with the body of the deposition head and is energized by a high-voltage generator, not shown. At its lower end, the glass body 20 is surrounded by a metal foil 4 that acts as an auxiliary electrode. When the device is operating, an electrostatic field will be established between a counter-electrode 5 and the electrodes 3 and 4, the counter-electrode 5 being shown schematically and typically being at ground potential. The counter-electrode 5 is shaped to receive the container that is to be coated with a sterilizing agent. As shown in FIGS. 1, 3 and 4, the containers are open-topped plastic pots which are supported by and move with a conveyor. The aforementioned electrostatic field is the means whereby the droplets of sterilizing agent, which have been charged by passage through the corona discharge at the tip of electrode 3, are caused to be electrostatically directed to and deposited on the container wall surfaces.

The droplets of sterilizing agent are continually produced in an aerosol generator, not shown, which includes an ultrasonic transducer that operates at frequencies in the MHz range. The droplets of sterilizing agent are supplied to the deposition head 2 with the aid of a stream of air or other carrier gas that is pulsed in accordance with a timed sequence. The quantity of sterilizing agent is controllable by adjustment of the length of the pulses of carrier gas.

As best seen from FIG. 2, the glass body 20 of deposition head 2 has a central tube which defines the inner wall of a flow passage **2*a* for the sterilizing agent. The central tube also defines the inner conduit of a two-leg flow passage 2*b*. In the prior art, in the interest of minimizing the condensation of sterilizing agent on surfaces within the deposition head, warmed air has been supplied to the inner of the two generally coaxial legs of flow passage 2*b*** and has subsequently been exhausted from the outer of these legs.

The deposition head 2 and the counter-electrode 5 are relatively moved, in a timed sequence, between an operating position in which the container to be sterilized is positioned between the head and counter-electrode, as shown in FIG. 1, and an opening position in which the deposition head is withdrawn from the container. These sequential movements are produced by actuating means, not shown.

When the surface(s) of a non-coductive container to be sterilized are being coated with comparatively large quantities of the sterilizing agent, these surfaces becomes charged, more or less rapidly, as a result of the deposition of the electrically charged aerosol droplets thereon. The charge on the container surface will build up to a constant electric field which screens the intense field at the point of electrode 3. When this happens, the corona discharge will be extinguished thus terminating the process whereby the aerosol is electrostatically charged and deposited.

According to a first functional improvement of the invention, shown schematically in FIG. 4, the reduction of deposition to an insufficient level and the eventual extinguishing of the corona discharge is prevented by reversing the polarity of the point electrode which is indicated at 13 in FIG. 4. This polarity switching will, for example, be accomplished manually or automatically following a measurable decrease in the corona current. The polarity reversal is accomplished by connecting the corona point to a positive potential and a negative potential in alternating succession. The stream of aerosol will thus, in turn be, negatively and positively charged. In both cases, the charged droplets are directed, within the field between the corona point and the grounded outer electrode 5, to the non-conductive container surface that is located between electrodes 5 and 13.

The above-mentioned counter-polar surface charging process brings about an increase in the effective field strength, which is only gradually reduced again as a result of further deposition. By thus reversing the polarity of the corona point at regular intervals, any desired quantity of superfine aerosol can be deposited in a manner such that the sterilizing agent will be uniformly distributed over the container surfaces.

In the apparatus shown in the drawings, which is utilized for sterilizing containers destined to receive foodstuffs, the deposition head 2 is inserted into a container to be sterilized from above so as to deposit superfine aerosol droplets on the interior surfaces of the container, either in a single layer or in multiple layers. Operational problems may occur when dense aerosol streams are utilized. These problems, and the resulting undesirable effects, take the form of the formation of drops of liquid on the deposition head itself as a result of its being "bombarded" with the droplets in the carrier gas stream. The formation of liquid deposits on the surfaces of the deposition head also results as a consequence of the centrifugal forces that accompany changes in the carrier gas stream direction. As a result of this unwanted deposition, comparatively large drops of the liquid sterilization medium may fall onto the container surfaces that are to be uniformly coated. This will adversely affect the process by preventing the formation of a uniform coating and by delaying the subsequent drying or fixing of the coating. In order to remedy the problem of formation of drops of sterilizing agent on surfaces of the deposition head, it has been the prior practice to preheat the head 2 with warmed air delivered to the inner conduit of flow passage **2*b***.

It has been discovered that the circulation of a heated liquid through the flow passage **2*b*, as depicted schematically in FIG. 3, provides better results than achieved using warmed air. In either event, the temperature of the fluid to be circulated is determined by the "weakest point" on the deposition head. Considering FIG. 1, the "weakest point " is the point at which the stream of aerosol strikes a surface within the body 20** with a large velocity component that is more or less perpendicular thereto. At this point or points, i.e., on surfaces facing upstream, the temperature is substantially reduced by the surface cooling that is brought about by the carrier gas and by maximum "droplet bombardment".

In accordance with the present invention, that portion of the deposition head which exhibits the greatest tendency to collect droplets will be directly heated so as to be maintained at a higher temperature than the remainder of the deposition head. This may, for example, be accomplished by means of an electric heating tape 15 (FIGS. 3 and 4). The heating tape may, of course, be applied to surfaces which are directly impinged upon by the carrier gas for the atomized sterilizing agent rather than being located as shown in FIGS. 3 and 4 and may be on the "outer" surface which is opposite to that inpinged upon by the droplets.

As a further functional improvement of the present invention, as shown in FIGS. 3 and 4, the deposition head 2 is provided with an enlarged chamber 16 upstream of the inlet end to flow passage 2*a*. An inlet nozzle 9 for the sterilizing agent projects into chamber 16. A circumferential continuous trap bead 10 is provided about the base of chamber 16 slightly below the upper end of the glass body 20. In the interest of ensuring reliable operation, and particularly to avoid drop formation, swirl effects and electrical flash-overs, the inlet nozzle 9 is located at a defined distance from the trap bead 10. Downward dripping of the aerosol into passage 2*a* is positively prevented by the use of the trap bead 10, i.e., liquid condensing on the wall of chamber 16 will flow downwardly into the bead 10. The liquid is drained off from bead 10 via a discharge nozzle 10*a*. The heating tape 15 is not necessary when the trap bead and nozzle 10*a* combination is utilized and condensate is withdrawn from the base of chamber 16.

In a modified embodiment, the deposition head 2 can be operated in a manner such that the superfine aerosol is directed upwardly against the surfaces that are to be coated, and this automatically prevents dripping and, consequently, eliminates the need for heating. Thus, the apparatus shown in FIGS. 3 and 4 can be inverted in which case the only structural changes required would be relocation of nozzle 10*a* and the provision of guide means for receiving the flanged lips of the containers to be sterilized which would, with the apparatus inverted, be supported on, rather than suspended from, a conveyor.

As shown in FIG. 1, the electrode 3 extends along and is coaxial with the inner leg of the flow passage 2*b*. Since the electrode of the prior art apparatus is not insulated, it is necessary that a non-conducting fluid medium be employed for heating the deposition head 2. In the course of long periods of operation, deposits can accumulate in the flow passage 2*b* and these deposits may cause undesirable leakage currents.

In order to overcome the problem discussed immediately above, a small-diameter tube 11 may be installed on the axis of deposition head 2, i.e., coaxial with the inner leg of flow passage 2*b*. The tube 11 will be comprised of an insulator, for example a dense ceramic material, and its upper and lower ends will be securely connected to the central tube of the deposition head, which defines flow passage 2*b*, via seals 12*a*, 12*b* (see FIG. 4). In the FIG. 4 embodiment, the corona point 13 is in the form of a long wire which will be inserted into the small-diameter ceramic tube 11. The distance of wire 13 extends beyond the end of the deposition head will be adjusted to optimize the sterilization procedure and it is to be noted that it is relatively easy to exercise control over the exposed length of the electrode and to replace the electrode. As depicted schematically, the electrode 13 will be connected to the high voltage generator via a high-voltage cable.

The point electrode may, alternatively, be configured as a replaceable pointed tip 17 (see FIG. 3) which will be received in or on the central tube portion of the deposition head 2 in a manner which permits removal. The pointed tip 17 will, when installed, mate with an insulated electrical conductor 18 located within the central tube whereby insertion of the tip 17 will complete an electrical circuit between the corona point and the high voltage source. In the FIG. 3 embodiment, the pointed tip 17 is received in an insert 19.

The deposition head 2 is comprised of an insulating material, preferably glass, and it is impossible to exclude the possibility of the head being damaged while in service. In order to prevent the production of glass splinters, especially in applications in the field of food technology, a further improvement according to the invention involves providing the deposition head 2 with a tough plastic coating 21, shown partly and schematically in FIG. 4, which is both heat-resistant and chemically stable. The coating 21 may be applied to the exterior and, if deemed necessary also the interior, surfaces of head 2 by powder-coating and subsequent baking. The coating 21 is preferably transparent and also protects the metal foil auxiliary electrode 4 from mechanical, chemical or electrochemical corrosion. The coating 21 also, by virtue of its high electrical resistance, prevents arc-over between the head 2 and the grounded electrode 5.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In apparatus for sterilizing containers, the apparatus utilizing a liquid sterilizing agent and comprising an aerosol generator for producing droplets of the sterilizing agent, the apparatus further comprising a deposition head assembly in which the produced droplets, entrained in a stream of carrier gas, are directed to and charged by a corona discharge and are subsequently electrostatically deposited onto the surfaces of a container, the deposition head assembly comprising a deposition head which extends into the container, the deposition head defining a first flow passage for the carrier gas with entrained droplets, the first flow passage having an inlet which communicates with the exterior of the deposition head, the deposition head also comprising a centrally disposed point electrode energized by a high voltage to thereby produce the corona discharge and an auxiliary electrode which is provided on the end portion of the deposition head, said first flow passage extending linearly between said inlet and the region of the corona discharge, the head assembly further comprising an outer electrode which at least in part surrounds the container, a potential difference which produces an electrostatic field for causing the deposition of the charged droplets of sterilizing agent being established between the outer electrode and the auxiliary electrode and point electrode, the improvement comprising:

means defining a chamber disposed upstream of an in communication with said first flow passage inlet, said chamber being provided at its lower point and along the outer wall thereof with a circumferentially continuous trap bead for collecting liquid; and nozzle means for discharging the stream of carrier gas with entrained sterilizing agent droplets into said chamber along an axis which is not aligned with the first flow passage.

2. The apparatus of claim 1 further comprising:

means for switching the polarity of the voltage applied to the point electrode between positive and negative potentials relative to the outer electrode.

3. The apparatus of claim 2 wherein said improvement further comprises:

means responsive to the corona current for controlling said switching means whereby the polarity of the point electrode relative to the outer electrode will be switched in response to a predetermined decrease in the corona current.

4. The apparatus of claim 3 wherein the deposition head has an axis and wherein the first flow passage is in part defined by a central tube which is arranged coaxially with the deposition head axis, and wherein said improvement comprises an improved point electrode including a tubular rigid insulator mounted coaxially with the central tube and sealed thereto adjacent opposite ends thereof and a wire which is coaxial with said rigid insulator tube and projects beyond a first end thereof.

5. The apparatus of claim 2 wherein said deposition head has an axis and wherein the first flow passage is in part defined by a central tube which is coaxial with the deposition head axis, and wherein said improvement further comprises an improved point electrode including a pointed tip removably supported from the end of the central tube and an insulated electrical conductor for connecting said pointed tip to the high voltage source.

6. The apparatus of claim 1 wherein said improvement further comprises:

a coating of heat-resistant and chemically inert plastic on at least a portion of an external surface of said deposition head.

7. The apparatus of claim 1 wherein said chamber is provided with a drain port in communication with said continuous trap bead.

8. The apparatus of claim 1 wherein the deposition head has an axis and wherein the first flow passage is in part defined by a central tube which is coaxial with the deposition head axis, and wherein said improvement comprises an improved point electrode including a tubular rigid insulator mounted within and coaxially with said central tube and sealed thereto adjacent opposite ends of said tube, and a wire which is coaxial with said rigid insulator and projects beyond a first end thereof.

9. The apparatus of claim 8 wherein said wire is replaceable and the projection thereof may be adjusted to vary the length of said point electrode.

10. The apparatus of claim 8 further comprising:

means for switching the polarity of the voltage applied to the point electrode between positive and negative potentials relative to the outer electrode.

11. The apparatus of claim 1 wherein the deposition head includes a further flow passage for a heated fluid, heat being transferred from the fluid in the further flow passage to a surface which defines the first flow passage, said improvement further comprising:

means for delivering a heated liquid to the further flow passage.

12. The apparatus of claim 11 wherein said improvement further comprises:

means for heating at least a first surface region of the deposition head to a temperature which is above the temperature resulting from flow of the heated liquid.

13. The apparatus of claim 12 wherein the deposition head has an axis and wherein the first flow passage is in part defined by a central tube which is arranged coaxially with the deposition head axis, and wherein said improvement comprises an improved point electrode including a tubular rigid insulator mounted coaxially with the central tube and sealed thereto adjacent opposite ends thereof and a wire which is coaxial with said rigid insulator tube and projects beyond a first end thereof.

14. The apparatus of claim 12 wherein said deposition head has an axis and wherein the first flow passage is in part defined by a central tube which is coaxial with the deposition head axis, and wherein said improvement further comprises an improved point electrode including a pointed tip removably supported from the end of the central tube and an insulated electrical conductor for connecting said pointed tip to the high voltage source.

15. The apparatus of claim 11 further comprising means for switching the polarity of the voltage applied to the point electrode between positive and negative potentials relative to the outer electrode.

16. The apparatus of claim 1 wherein said improvement further comprises:

means for heating at least a first surface area of the deposition head.

17. The apparatus of claim 16 wherein said deposition head has an axis and wherein the first flow passage is in part defined by a central tube which is coaxial with the deposition head axis, and wherein said improvement further comprises an improved point electrode including a pointed tip removably supported from the end of the central tube and an insulated electrical conductor for connecting said pointed tip to the high voltage source.

18. The apparatus of claim 16 wherein the deposition head has an axis and wherein the first flow passage is in part defined by a central tube which is arranged coaxially with the deposition head axis, and wherein said improvement comprises an improved point electrode including a tubular rigid insulator mounted coaxially with the central tube and sealed thereto adjacent opposite ends thereof and a wire which is coaxial with said rigid insulator tube and projects beyond a first end thereof.

19. The apparatus of claim 1 wherein the deposition head has an axis and wherein the first flow passage is defined by a central tube which is coaxial with the deposition head axis, and wherein said improvement further comprises an improved point electrode including a pointed tip removably supported from the end of said central tube and an insulated electrical conductor for connecting said pointed tip to the high voltage source.

20. The apparatus of claim 19 further comprising:

means for switching the polarity of the voltage applied to the point electrode between positive and negative potentials relative to the outer electrode.

* * * * *